US008596810B2

(12) United States Patent
Lin et al.

(10) Patent No.: US 8,596,810 B2
(45) Date of Patent: Dec. 3, 2013

(54) LIGHTING DEVICE WITH EMERGENCY ILLUMINATION FUNCTION

(75) Inventors: Chih-Hen Lin, Taipei (TW); Wen-Pin Liang, Pingzhen (TW)

(73) Assignee: Kepro Development Inc., Taipei (TW)

( * ) Notice: Subject to any disclaimer, the term of this patent is extended or adjusted under 35 U.S.C. 154(b) by 6 days.

(21) Appl. No.: 13/371,502

(22) Filed: Feb. 13, 2012

(65) Prior Publication Data

US 2013/0208453 A1 Aug. 15, 2013

(51) Int. Cl.
*F21L 4/00* (2006.01)
*F21L 13/00* (2006.01)

(52) U.S. Cl.
USPC ..... 362/183; 362/197; 362/253; 362/414

(58) Field of Classification Search
USPC ..... 362/20, 183, 197–199, 253, 260, 285, 362/287, 368, 410, 414, 443
See application file for complete search history.

(56) References Cited

U.S. PATENT DOCUMENTS

| | | | | |
|---|---|---|---|---|
| 5,703,751 | A * | 12/1997 | Huang | 361/625 |
| 2010/0039792 | A1* | 2/2010 | Meyers et al. | 362/20 |
| 2010/0039801 | A1* | 2/2010 | Pelletier et al. | 362/184 |
| 2011/0199726 | A1* | 8/2011 | Moser | 361/679.09 |
| 2013/0061412 | A1* | 3/2013 | Vashi | 15/106 |

* cited by examiner

*Primary Examiner* — Anh Mai
*Assistant Examiner* — Kevin Quarterman
(74) *Attorney, Agent, or Firm* — Alan Kamrath; Kamrath IP Lawfirm, P.A.

(57) ABSTRACT

A lighting device includes a base (1) and a light (2). The light (2) includes a housing (21) receiving a controller (22) electrically connected to a lighting element (24), a chargeable battery (25), and a switch module (26). A female coupler (3) is provided on one of the base (1) and the light (2). A male coupler (4) is provided on the other of the base (1) and the light (2). The female coupler (3) is detachably engaged with the male coupler (4) to detachably mount the light (2) to the base (1). The light (2) is detachable from the base (1) and can be used independently.

1 Claim, 9 Drawing Sheets

LIGHTING DEVICE WITH EMERGENCY ILLUMINATION FUNCTION

BACKGROUND OF THE INVENTION

The present invention relates to a lighting device with emergency illumination function and, more particularly, to a lighting device that can provide normal illumination and emergency illumination as well as serve as a flashlight.

Ordinary lights and table lamps must be supplied with regular power supply. Emergency lights are used in cases of interruption or off line of electricity. Specifically, the batteries of the emergency lights are charged in normal conditions and are activated to provide illumination for emergency use. Namely, the emergency lights do not provide the illumination function, whereas ordinary lights can not be used in emergency. Thus, both of the ordinary lights and emergency lights are used in houses and offices, failing to provide a beautiful environment while increasing the costs.

BRIEF SUMMARY OF THE INVENTION

The primary objective of the present invention is to provide a light that can provide normal illumination and emergency illumination as well as serve as a flashlight. The light can be rapidly installed and positioned without using bolts when serving as a table lamp or emergency light. The light can be easily detached and used as a flashlight.

To fulfill the above objective, the present invention provides a lighting device including, a base and light. The light includes a housing receiving controller electrically connected to a lighting element, a chargeable battery, and a switch module. A female coupler is provided on one of the base and the light. A male coupler is provided on the other of the base and the light. The female coupler is detachably engaged with the male coupler to detachably mount the light to the base. The light is detachable from the base and can be used independently.

The present invention will become clearer in light of the following detailed description of illustrative embodiments of this invention described in connection with the drawings.

DETAILED DESCRIPTION OF THE INVENTION

Figure 1:
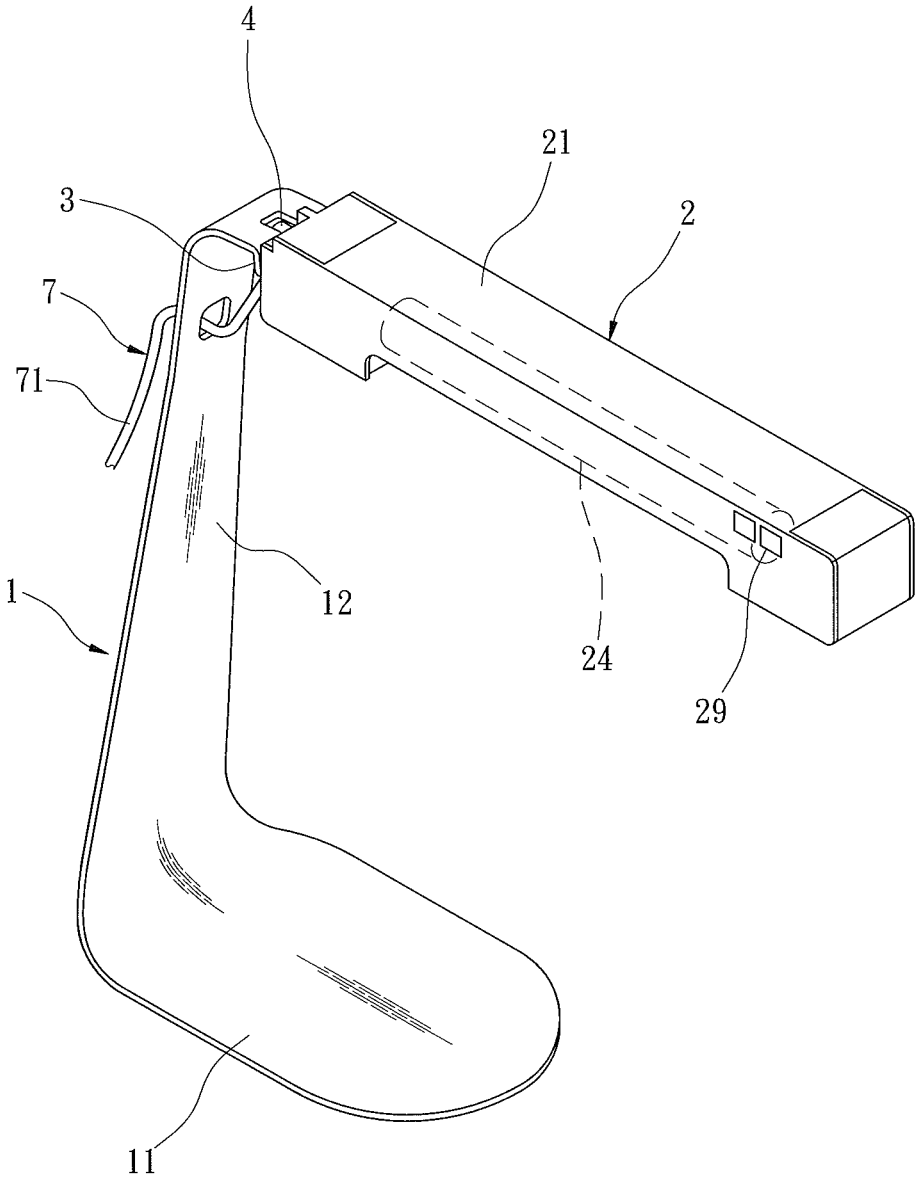
FIG. 1 shows a perspective view of a lighting device according to the present invention.
Figure 2:
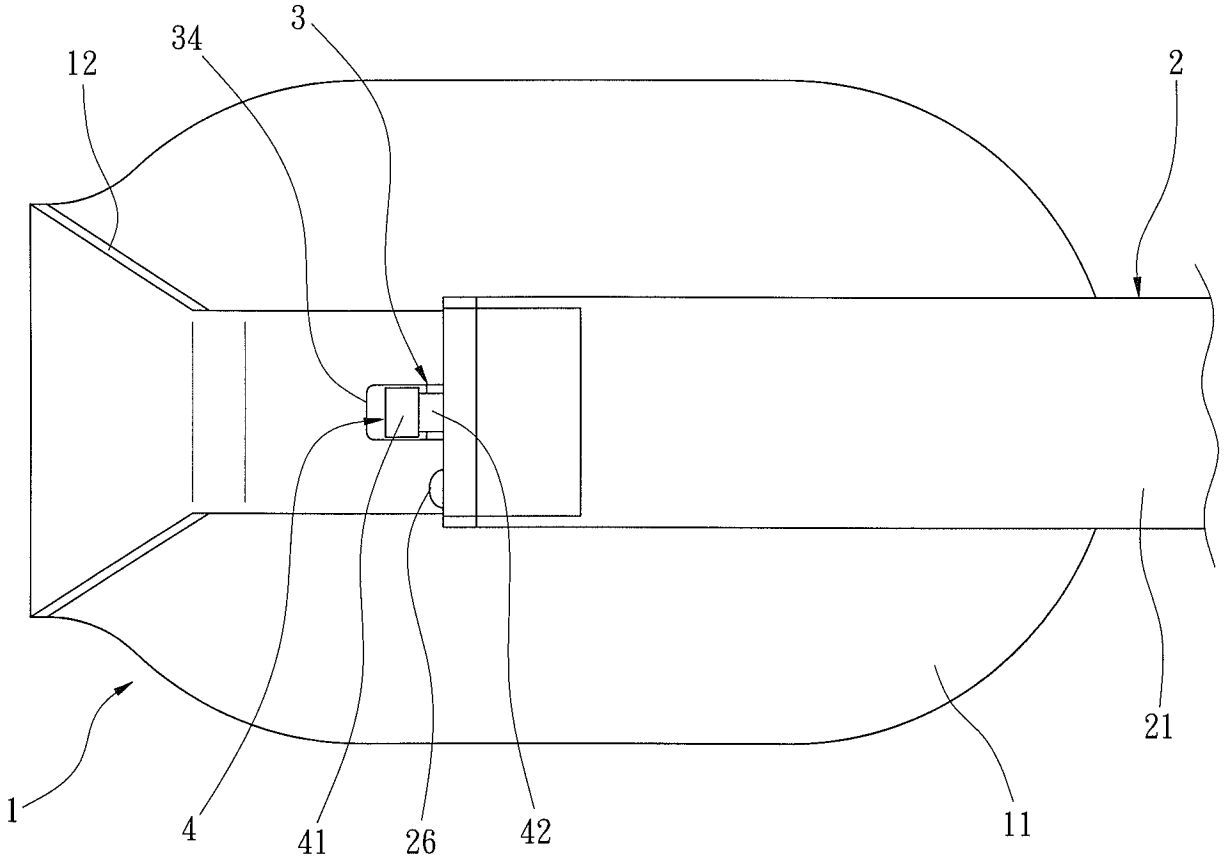
FIG. 2 shows a partial, top view of the lighting device of FIG. 1.
Figure 3:
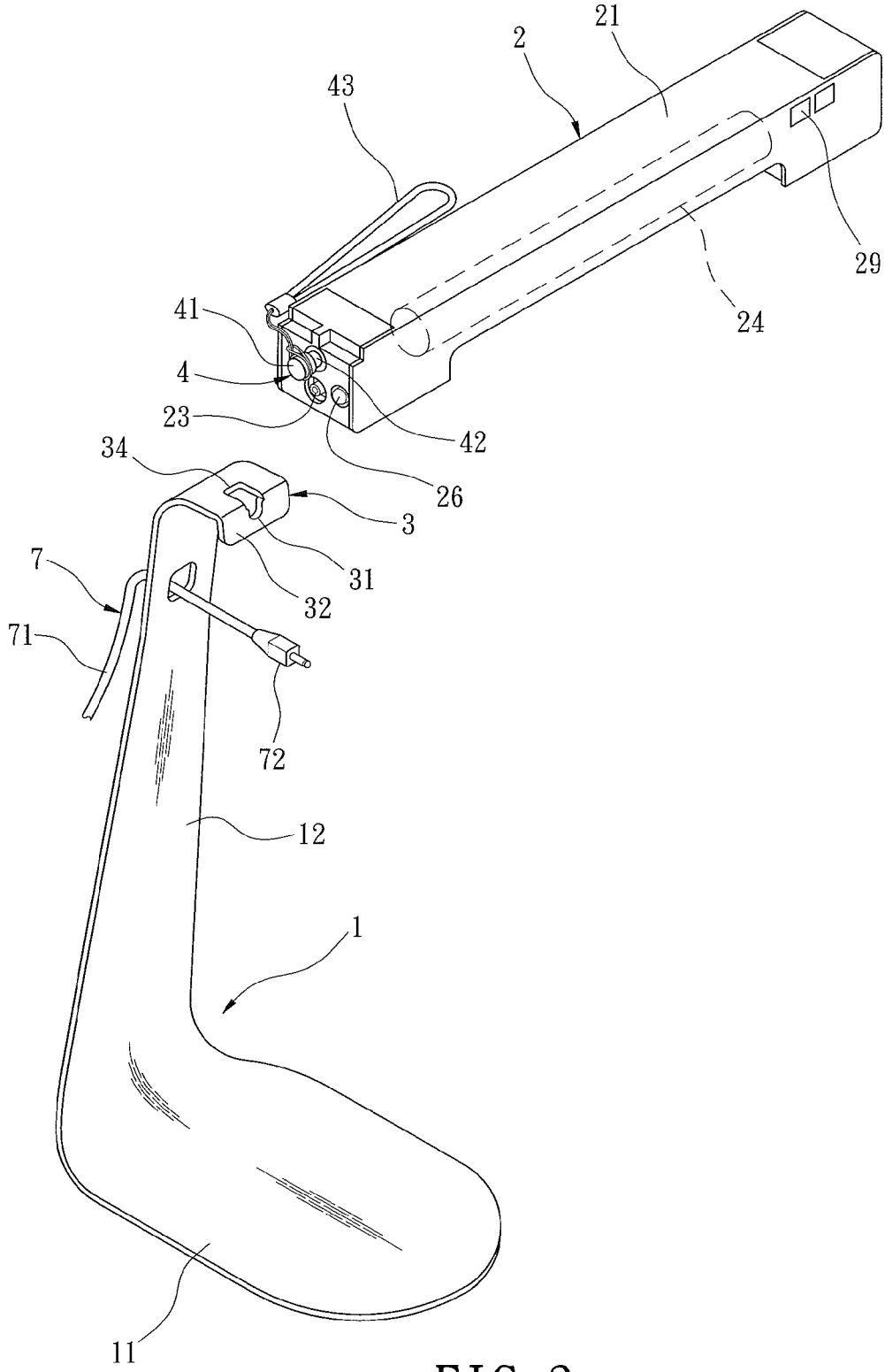
FIG. 3 shows an exploded, perspective view of the lighting device of FIG. 1.
Figure 4:
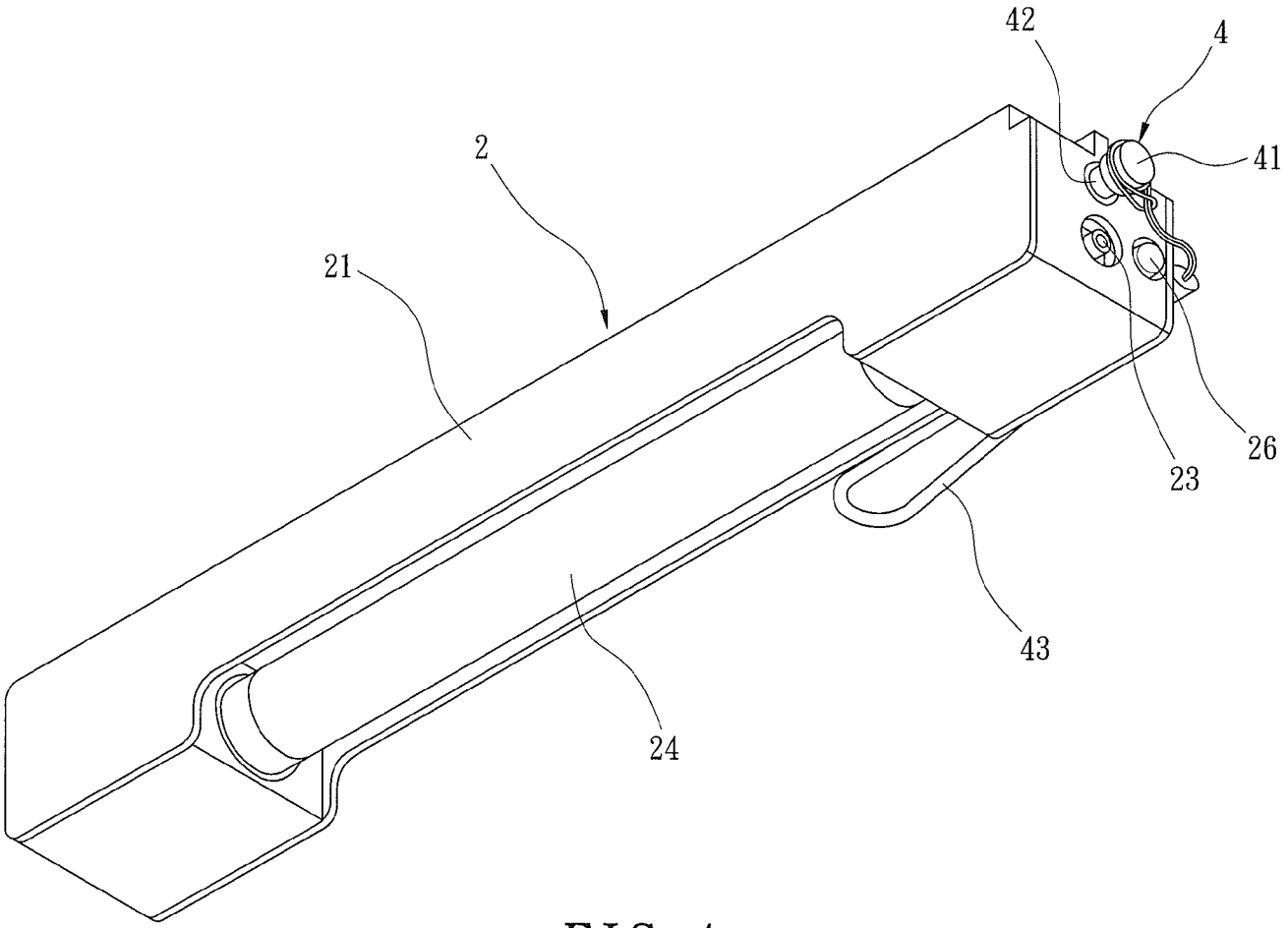
FIG. 4 shows a bottom perspective view of the lighting device of FIG. 3.
Figure 5:
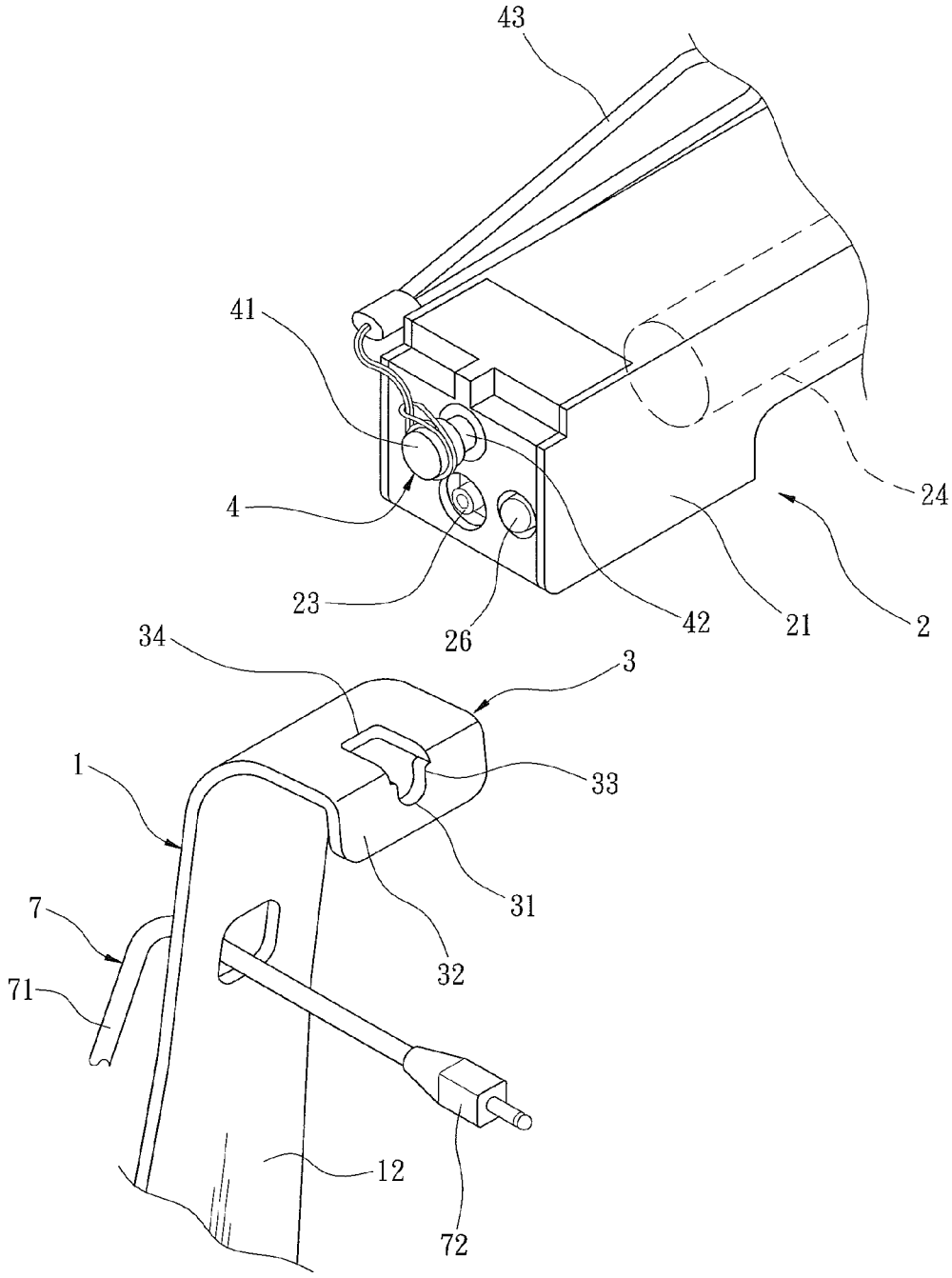
FIG. 5 shows an enlarged perspective view of the main components of the lighting device of FIG. 3.
Figure 6:
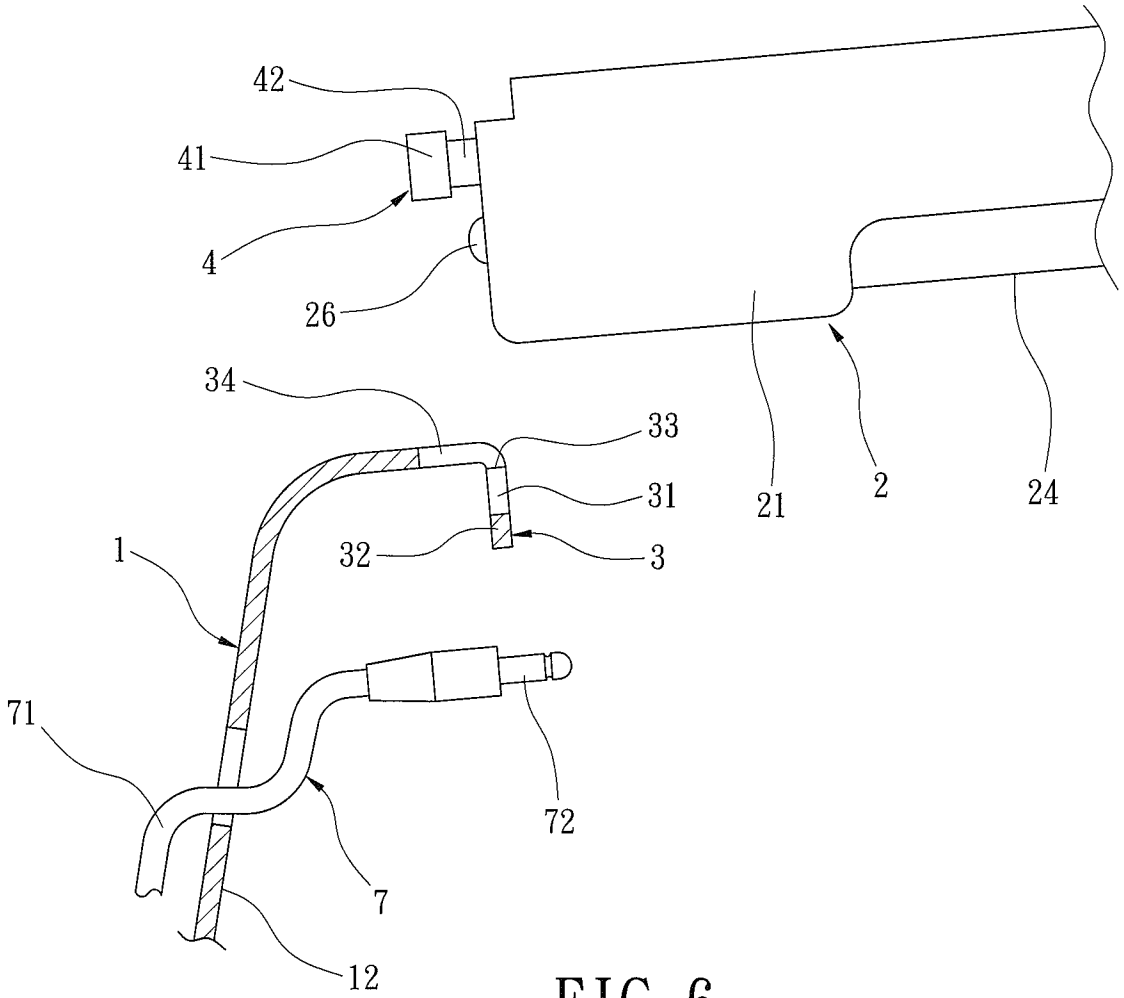
FIG. 6 shows a partial, exploded, perspective view of a light and a base of the lighting device of FIG. 3, with the base sectioned.
Figure 7:
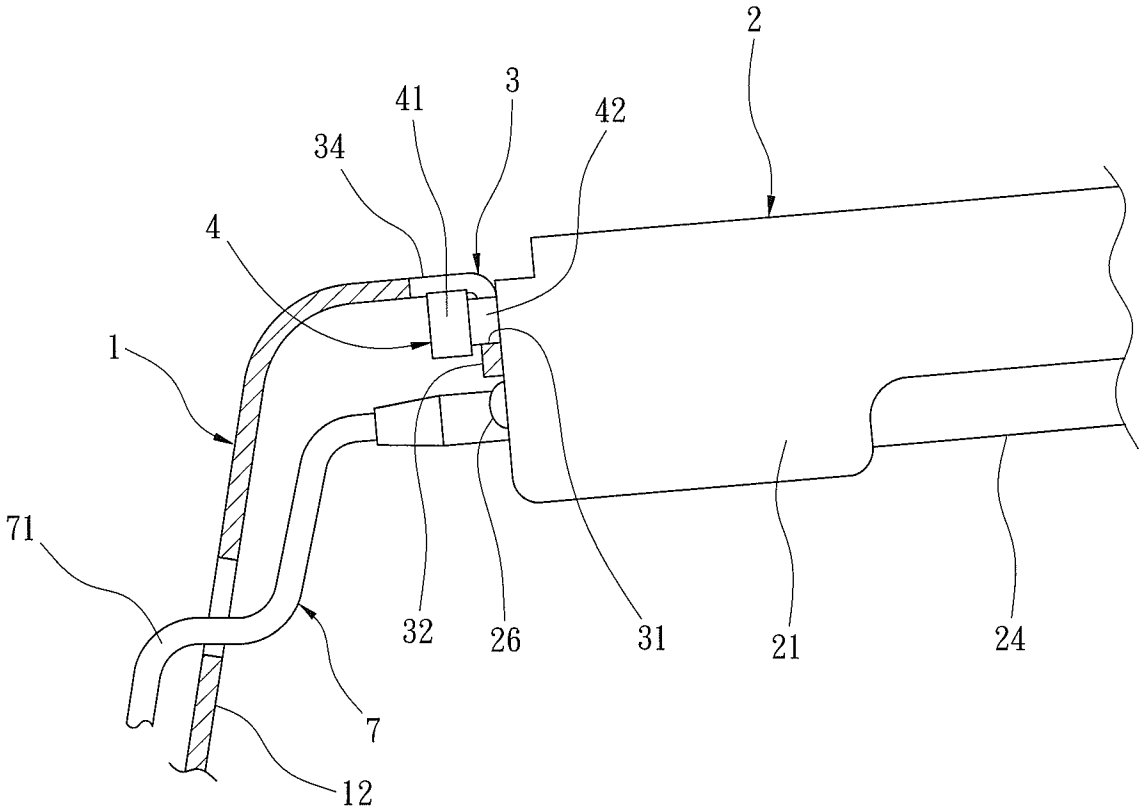
FIG. 7 shows a view of the light and the base of FIG. 6 after assembly.

With reference to FIGS. 1-8, the lighting device according to the present invention can provide normal illumination and emergency illumination as well as serve as a flashlight. The lighting device includes a base 1 and a light 2. Light 2 can be attached to base 1 to serve as a table lamp in normal conditions or as an emergency light during blackout, as shown in FIGS. 1 and 2. Light 2 can be detached from base 1 and serve as a flashlight or a portable emergency light, as shown in FIGS. 3 and 4.

Base 1 includes a seat 11 and a support 12 extending from seat 11. A female coupler 3 is provided on one of support 12 and light 2. A male coupler 4 is provided on the other of support 12 and light 2 and is detachably engaged with female coupler 3. In the form shown, female coupler 3 is provided on support 12, and male coupler 4 is fixed on an end of light 2. Support 12 includes an inverted L-shaped head having a horizontal section and a vertical section 32. Female coupler 3 includes a slot 34 in the horizontal section and a retaining notch 31 in vertical section 32 and in communication with slot 34. Male coupler 4 includes a connection peg 41 having a reduced section with an annular groove 42. Connection peg 41 is inserted into slot 34 from above, with the reduced section engaged in retaining notch 31. Namely, the reduced section is held between two lateral walls 33 of retaining notch 31. Thus, light 2 can be reliably positioned on base 1 to serve as a table lamp in normal conditions or as an emergency light. Assembly of the lighting device is easy without using bolts and tools.

Figure 8:
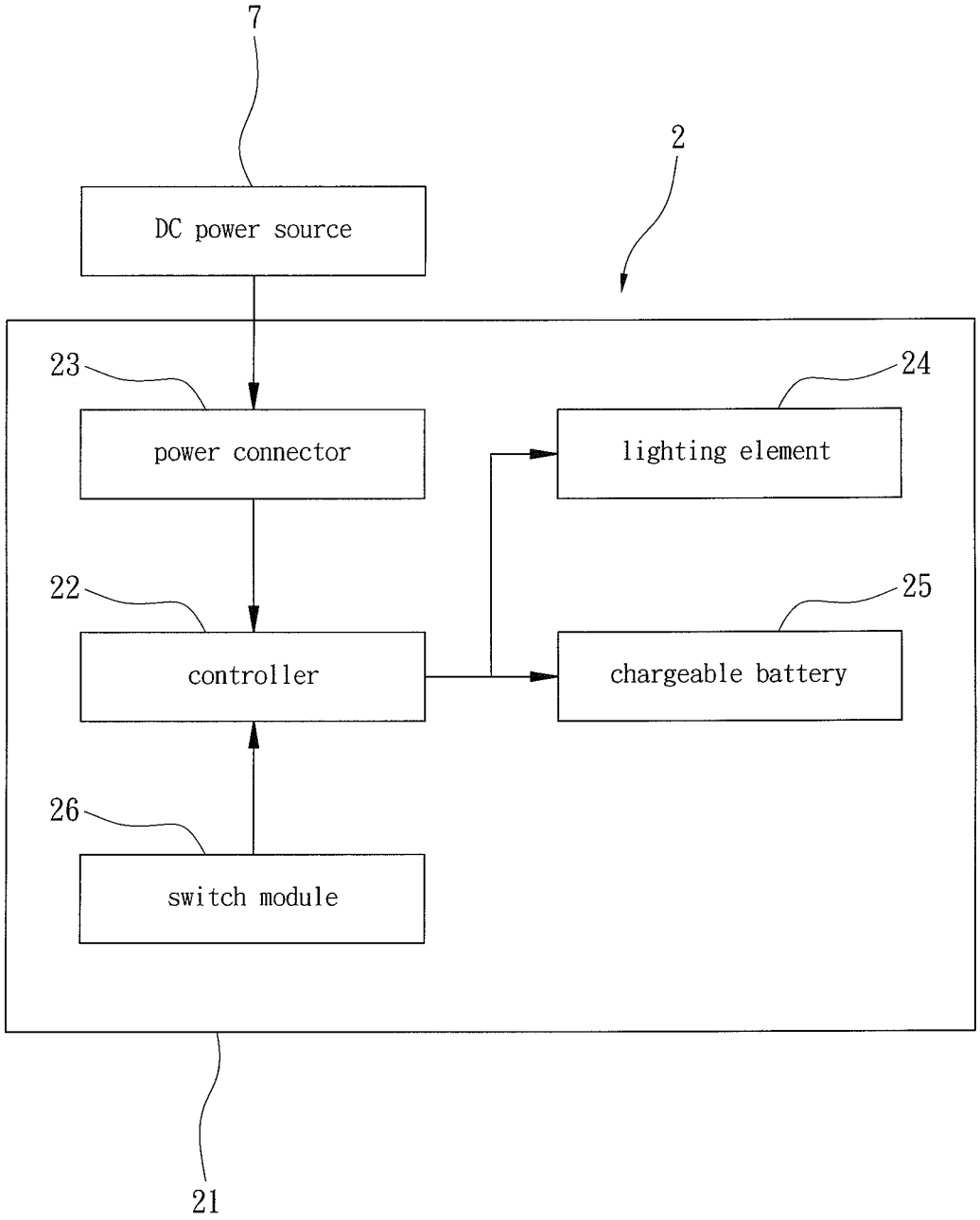
FIG. 8 shows a block diagram of the lighting device according to the present invention using a DC power source.
Figure 9:
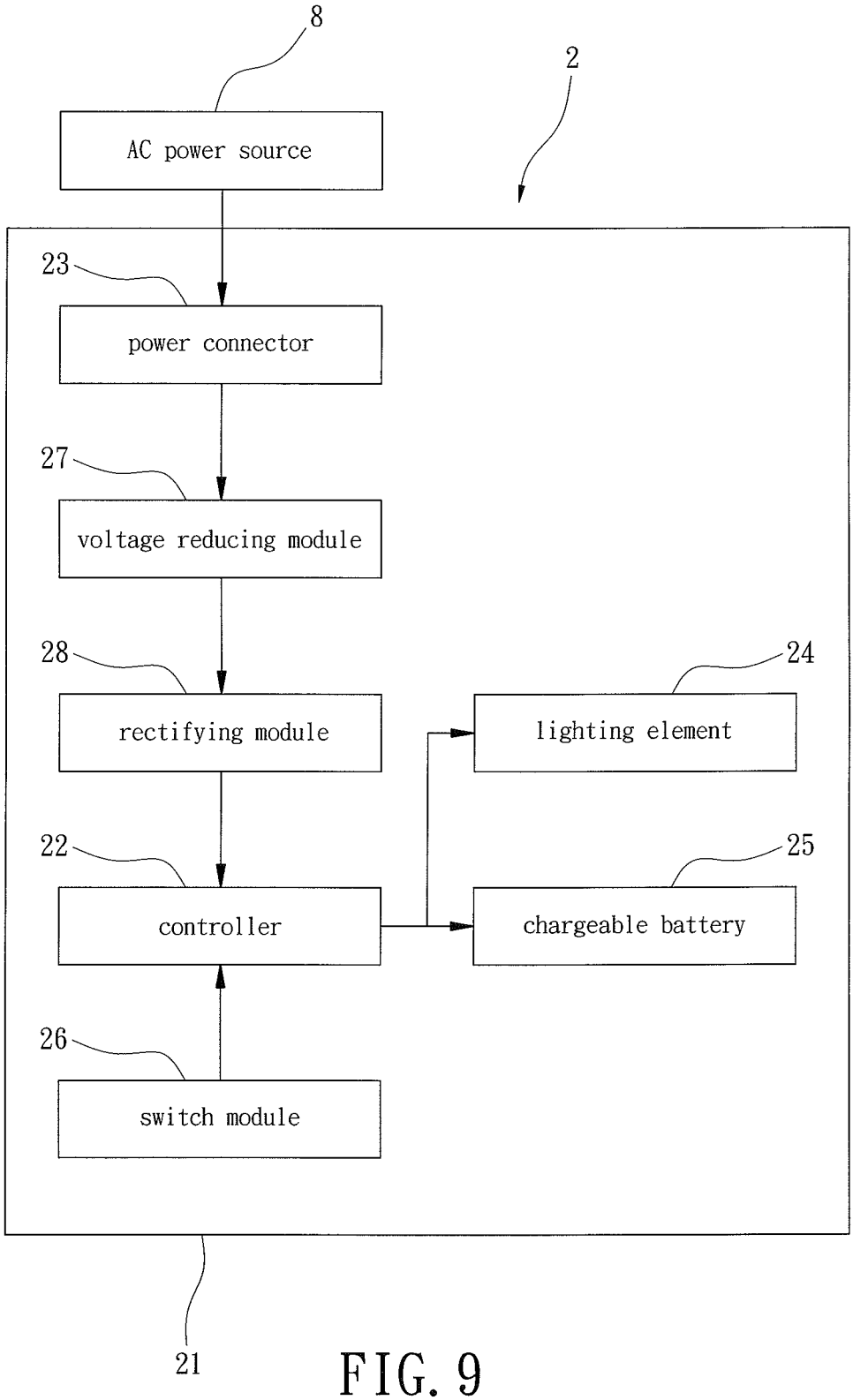
FIG. 9 shows a block diagram of lighting device according to the present invention using an AC power source.

A controller 22 (FIG. 8) is mounted in a housing 21 of light 2 and electrically connected to a power connector 23, a lighting element 24, a chargeable battery 25, a switch module 26, and indicator lamps 29. Power connector 23 is connected to a plug 72 on an end of a power cable 71 of an external DC power source 7, as shown in FIG. 8. Lighting element 24 can be a light-emitted diode (LED), a light tube, or the like. In another example shown in FIG. 9, the lighting device can be used with an AC power source 8, with a voltage reducing module 27 and a rectifying module 28 mounted between AC power source 8 and controller 22.

When it is desired to use light 2 independently, external DC power source 7 is unplugged, and male coupler 4 is disengaged from male coupler 3. Thus, light 2 including chargeable battery 25 can be used as a flashlight or emergency light. A strap handle 43 can be attached to light 2 for easy carriage.

Male coupler 4 can be provided on base 1, and female coupler 3 can be provided on light 2. Furthermore, male and female couplers 4 and 3 can be of other types. As an example, female coupler 3 can be a hole, and male coupler 4 can be a rod having a spring-biased member that can be forcibly inserted into or removed out of the hole.

Although specific embodiments have been illustrated and described, numerous modifications and variations are still possible without departing from the essence of the invention. The scope of the invention is limited by the accompanying claims.

The claimed invention is:

1. A lighting device comprising a base and a light, with the light including a housing receiving a controller electrically connected to a lighting element, a chargeable battery, and a switch module, with a female coupler provided on one of the base and the light, with a male coupler provided on the other of the base and the light, with the female coupler detachably engaged with the male coupler to detachably mount the light to the base, with the light detachable from the base and useable independently, with the base including a support having an inverted L-shaped head with a horizontal section and a vertical section, with the female coupler including a slot defined in the horizontal section and a retaining notch defined in the vertical section and in communication with the slot, with the male coupler including a connection peg having a reduced section with an annular groove, with the connection peg received in the slot, with the reduced section engaged in the retaining notch and held between two lateral walls of the retaining notch.

* * * * *